United States Patent [19]

Fukae et al.

[11] Patent Number: 4,829,337

[45] Date of Patent: May 9, 1989

[54] CLEANING DEVICE FOR A PHOTOCONDUCTIVE PRINTER OR COPIER

[75] Inventors: Kensuke Fukae, Monsey, N.Y.; Shozo Kaieda, Okazaki, Japan

[73] Assignee: Kentek Information Systems, Inc., Allendale, N.J.

[21] Appl. No.: 33,458

[22] Filed: Apr. 1, 1987

[51] Int. Cl.[4] ..... G03G 15/08

[52] U.S. Cl. ..... 355/296; 355/300; 118/652; 430/125

[58] Field of Search ..... 355/15, 300, 140; 118/652; 15/1.5, 256.51, 256.52; 430/125

[56] References Cited

U.S. PATENT DOCUMENTS

| | | | |
|---|---|---|---|
| 4,390,268 | 6/1983 | Furuichi et al. | 355/15 |
| 4,411,042 | 10/1983 | Sakata et al. | 355/15 X |
| 4,568,175 | 2/1986 | Inowa et al. | 355/15 |
| 4,601,569 | 7/1986 | Garris | 355/15 |

FOREIGN PATENT DOCUMENTS

| | | | |
|---|---|---|---|
| 56-46280 | 4/1981 | Japan | 355/15 |
| 56-159678 | 12/1981 | Japan . | |
| 57-172379 | 10/1982 | Japan | 355/15 |
| 57-201278 | 12/1982 | Japan . | |
| 58-149084 | 9/1983 | Japan . | |
| 59-18981 | 1/1984 | Japan . | |
| 59-111675 | 6/1984 | Japan | 355/15 |
| 59-197072 | 11/1984 | Japan | 355/15 |

OTHER PUBLICATIONS

Xerox Disclosure Journal, Donald Seanor, "Fiber Brush Cleaning System", vol. 8, No. 3, May/Jun. 1983.

*Primary Examiner*—A. C. Prescott
*Assistant Examiner*—Jane Lau
*Attorney, Agent, or Firm*—Marmorek, Guttman & Rubenstein

[57] ABSTRACT

A cleaning device for removing residual developer particles from a photoconductive element, such as a photoconductive belt, comprises a cleaning sleeve having a length substantially equal to the width of the photoconductive element. The cleaning sleeve includes a thin screen portion having apertures therein. The screen portion is maintained in contact with the photoconductive element. A biasing voltage is applied to the cleaning sleeve. Developer particles pass through the apertures in the screen portion. An auger is located in the interior of the cleaning sleeve. The auger transports the collected developer particles out of the cleaning sleeve where the particles may be either recycled or discarded.

10 Claims, 2 Drawing Sheets

CLEANING DEVICE FOR A PHOTOCONDUCTIVE PRINTER OR COPIER

BACKGROUND OF THE INVENTION

The present invention relates to a cleaning device for removing residual developer particles from a photoconductive element of an electrographic copier or printer. More particularly, the present invention relates to a cleaning device in the form of a screen mesh or grille for removing residual developer particles from a photoconductive element of an electrographic printer or copier.

In the process of electrophotographic or xerographic printing, a photoconductive member is employed to record an image. The photoconductive member, which may typically take the form of a belt or a drum, is charged to a substantially uniform potential to sensitize its surface. In the case of a copying machine, the charged portion of the photoconductive surface is exposed to a reflected light image of an original document to be reproduced. The light image is recorded as an electrostatic latent image on the photoconductive member corresponding to the informational areas contained on the original document.

In the case of a printer connected to a computer, a similar process is used to record information on the photoconductive member. The charged portion of the photoconductive surface is exposed to a light image, the shape of which is controlled by input signals from the computer. For example, a laser or an LED array receiving input signals from the computer functions as an optical print head and illuminates the photoconductive member with a light image of a particular shape. Here too, an electrostatic latent image corresponding to desired informational areas is recorded on the photoconductive member.

After recording the electrostatic latent image o the photoconductive member, the latent image is developed by bringing a developer material or toner into contact with it. The developer material is attracted to the electrostatic latent image and forms a powder image on the photoconductive member corresponding to the electrostatic latent image. The powder image is subsequently transferred to a sheet of recording medium, such as a sheet of paper. Thereafter, the powder image is permanently affixed to the sheet in image configuration by a variety of methods, such as by fusing.

The above-mentioned operations may be carried out by arranging a number of stations in sequence about the photoconductive member. Thus, the photoconductive member is usually surrounded in sequence by a charging station, an imaging station, a developing station, and a transfer station. A discharging station and a cleaning station are also arranged about the photoconductive member to ready it for use again.

As used herein, the term "electrographic printing apparatus" and the like are intended to include both copying and printing machines. Such machines include a developer unit operative to deliver toner with or without a carrier to the photoconductive member. Typically the toner is stored in a hopper where it is mixed with a suitable carrier. The carrier often comprises iron or other metal particles. When mixed with the carrier, the toner acquires a suitable electrostatic charge so that it may easily be transferred to the photoconductive element to develop the latent electrostatic image formed thereon. Usually, a cleaning device is also installed in the electrographic printing apparatus in order to remove toner and other developer particles such as the carrier which remain on the surface of the drum or the belt after the transfer of the developed image to the sheet of recording medium. In some cases, the cleaning device is integrated into the developer unit which alternately functions in either a developing or a cleaning mode.

Heretofore, a variety of devices and methods have been used to clean residual developer particles from the photoconductive belt or drum. Thus, the cleaning device often comprises a brush which is used to remove the developer particles. The brush has a length substantially equal to the width of the photoconductive element in order that the entire photoconductive element be swept clean. The cleaning brush is formed using a suitable material to attract the toner particles, and it is positioned to face the photoconductive element so that it may contact its surface in order to remove the residual developer material.

However, cleaning brushes are not entirely satisfactory for their intended purpose. A primary requisite for effective cleaning is that the cleaning brush and the surface of the photoconductive element be constantly held in even contact. While some implementations have heretofore been proposed to satisfy this requisite, problems have been encountered with such cleaning devices in that after an extended period of use of the electrographic printing apparatus, the pressing contact of the cleaning brush with the surface of the photoconductive element becomes uneven. This tends to bring about irregularity in the cleaning operation. In order to overcome this problem, complicated devices such as that described in U.S. Pat. No. 4,571,070 (Tomita), have been proposed.

In an alternative method of cleaning the photoconductive element, a scraper blade is applied to the photoconductive element. The scraper blade, typically made from a hard rubber material, is held against the photoconductive element and scrapes it free of residual toner particles. For example, U.S. Pat. No. 4,568,175 (Inowa et al) discloses a blade cleaning device for removing toner particles remaining on the surface of a photoreceptor.

Such blade-cleaning devices are not entirely satisfactory either. First, there is the problem of maintaining the blade in even contact with the surface of the photoconductive element. Particularly as time goes by, irregularities across the width of the blade occur so that the blade is no longer maintained in even contact with the photoconductive element. Second, in many cases the blade used to clean the photoconductive element may scratch the photoconductor surface. This is particularly true when the developer material is a two component developer which includes ferrite particles. The combination of the blade and the hard ferrite particles has a tendency to scratch the sensitive surface of the photoconductive element. Third, the cleaning blade must be maintained at a fixed angle to the photoconductive element. This necessitates the use of relatively complicated structures. For example, see the structure disclosed in U.S. Pat. No. 4,568,175 (Inowa et al).

Accordingly, it is an object of the present invention to provide a cleaning device for removal of developer material from a photoconductive element which cleaning device does not suffer from the deficiencies of prior art cleaning brushes and cleaning blades.

In particular, it is an object of the present invention to provide a cleaning device for removal of developer material from a photoconductive member which is not subject to the need for high tolerances of prior art cleaning brushes and cleaning blades.

It is a further object of the present invention to provide such a cleaning device which permits recycling of the developer particles remaining on the photoconductive element.

It is a further object of the present invention to provide such a cleaning device which is simple, cheap to construct, and can be attached to a disposable photoconductive belt assembly.

SUMMARY OF THE INVENTION

These and other objects are achieved by means of the present invention which comprises a cleaning device for removing residual developer particles from the photoconductive element of a xerographic copier or printing device. The cleaning device comprises a cleaning sleeve having a length substantially equal to the width of the photoconductive element. The cleaning sleeve includes a screen or sieve-like portion maintained in contact with the surface of the photoconductive element. The residual developer particles pass through the holes in the screen portion of the cleaning sleeve whereby they are removed from the photoconductive element and may be disposed of or recycled, as desired.

In a preferred embodiment of the invention, the cleaning sleeve is formed in the shape of a hollow cylinder with the screen portion forming a part of the surface of the cylinder. An auger or worm-screw is located in the interior of the hollow cylinder. The sleeve is maintained at a bias voltage of about +150 V to attract the developer particles. After the developer particles pass through the holes in the screen-like portion, the particles are transported away by the auger so that they may be disposed of or recycled.

DETAILED DESCRIPTION OF THE PREFERRED EMBODIMENT

Figure 1:
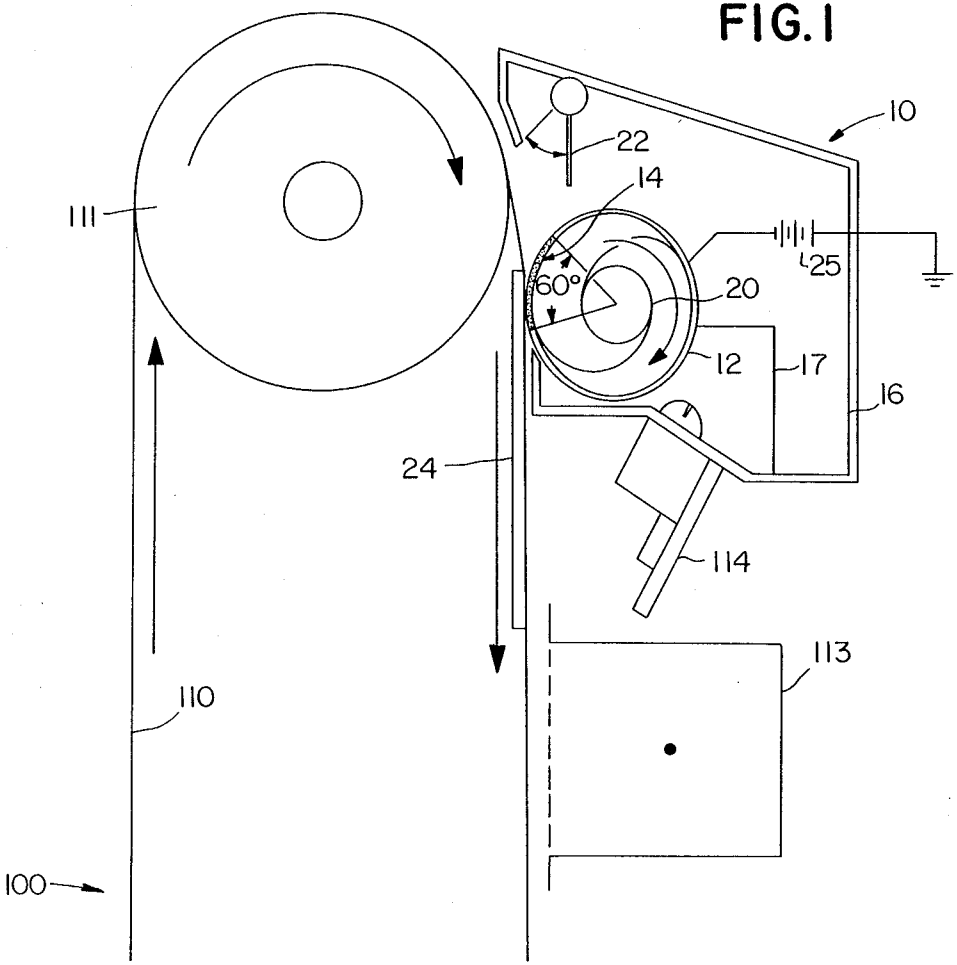
FIG. 1 illustrates a preferred embodiment of the cleaning device of the present invention.
Figure 2:
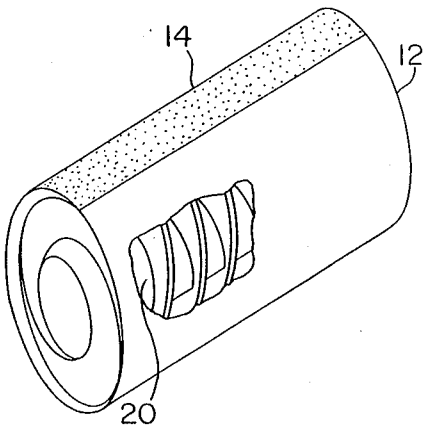
FIG. 2 is an exploded view of the cleaning device of the present invention.

Referring to the FIGS. 1 and 2, a cleaning device in accordance with the principles of the present invention is illustrated. The cleaning device, generally shown as 10, is arranged as a separate unit or a station opposite the photoconductive element 100. Cleaning device 10 is arranged after the transfer station in the electrographic printing apparatus. In this case, the photoconductive member 100 comprises a photoconductive belt 110 which rotates about the roller 111 in the direction shown by the arrows.

Desirably, the photoconductive element 100 is a disposable photoconductive belt assembly in the form of a disposable cassette described in allowed application Ser. No. 718,947, filed Apr. 2, 1985. This cassette is adapted to be vertically mounted in the electrographic printer/copier described in allowed application Ser. No. 700,813, filed Feb. 11, 1985. Both of these applications have been assigned to the assignee of the present application and both are incorporated herein by reference. In accordance with the present invention, cleaning device 10 is mounted directly onto the disposable cassette and is disposed along with it when the usable life of the photoconductive belt has been exceeded.

The cleaning device 10 comprises a hollow cleaning sleeve 12 of a length which is substantially equal to the width of the photoconductive belt 110. The cleaning sleeve 12 includes a screen portion 14 which is similar to the screen in certain kinds of electric razors. The screen 14 is made from metal or a conductive plastic material. It is thin, being about 0.8 to about 1.5 mm in thickness. The screen 14 is characterized in having numerous holes therein. Typically, carrier particles range in size from about 30 to 200 microns, usually about 30 to 50 microns, in diameter. Toner particles are smaller, averaging about 10 to 30 microns in diameter. The holes in screen portion 14 must be of a size to permit passage of the largest of these developer particles. Thus, the holes in screen portion 14 should be about 200 microns in diameter although other sizes can also be selected to accommodate different developers. The screen 14 forms a portion of the outer surface of the cleaning sleeve 12, for example, subtending 60 of arc of the sleeve.

A housing 16 is also provided which encloses cleaning device 10 as an individual unit. When necessary, cleaning device can be replaced as an entire unit although it is contemplated that in the normal course of events, cleaning unit 10 will be discarded when the entire cassette is replaced. Cleaning sleeve 12 is supported on housing 16 by means of resilient arm 17 which cooperates with backing plate 24 to maintain screen portion 14 in even contact with the photoconductive belt 110. Because cleaning unit 10 will be discarded periodically with cassette 100, the problem of maintaining even contact over an extended period of time does not arise.

A worm screw or auger 20 is disposed within the interior of cleaning sleeve 12. The purpose of auger 20 is to transport developer particles which have passed through screen portion 14 from the interior of sleeve 12 so that they may be recycled or discarded. A shutter 22 which is hinged to the top of housing 16 is also provided. Shutter 22 is employed in order to prevent spillage of the developer particles from cleaning device 10. Shutter 22 is activated to be open when photoconductive belt 110 is installed in the electrographic printing apparatus. Shutter 22 is shut when the cassette containing photoconductive belt 110 is removed from the printer copier.

In operation, a bias voltage of about +150 V is applied to cleaning sleeve 12 by means well known to those skilled in the art such as voltage source 25. Screen portion 14 is maintained in even contact with photoconductive belt 110 by cooperation of backing plate 24 and resilient arm (.not shown). Residual developer particles comprising carrier and toner particles remaining on belt 110 after transfer to the sheet has taken place are attracted to cleaning device 12 because of the biasing voltage applied thereto. These residual particles pass through the tiny apertures in screen portion 14 of cleaning device 12. The toner particles then fall into the windings of auger 20. Auger 20 rotates and thereby transports the developer particles out from the interior of cleaning device 12 where the toner particles are either recycled or discarded, preferably recycled.

Figure 3:
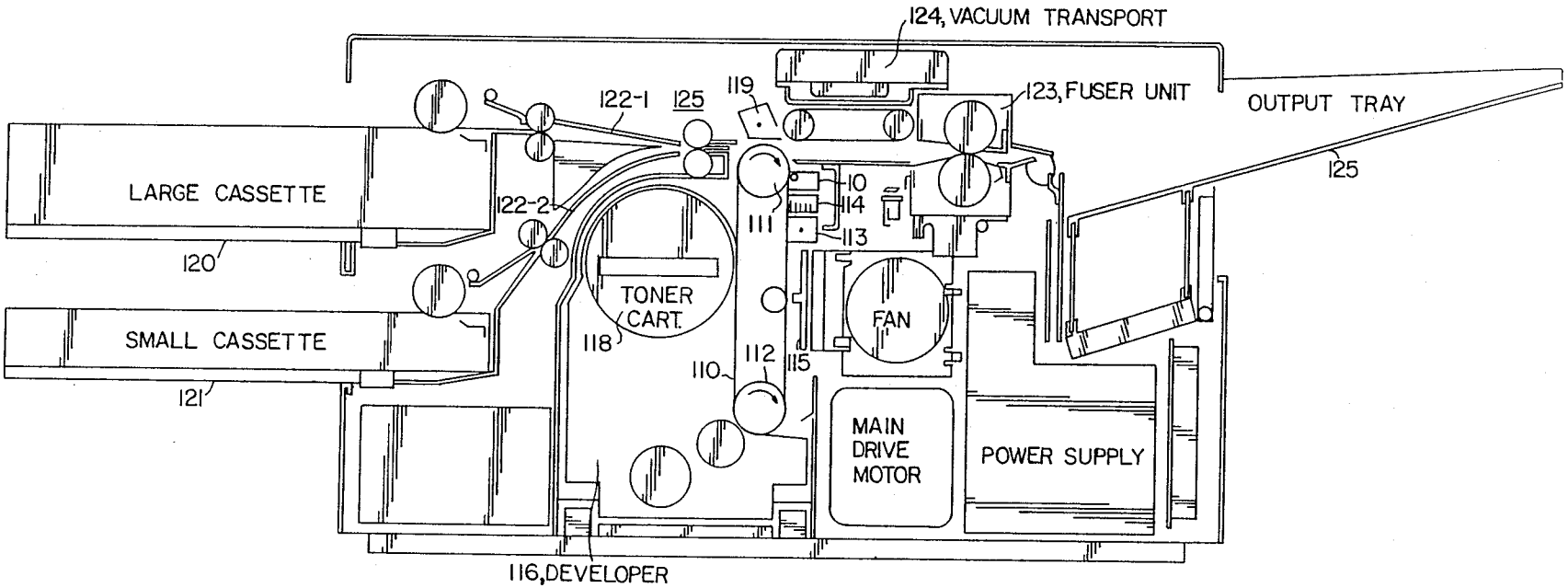
FIG. 3 is a schematic diagram of an electrographic printer employing the cleaning device of the present invention.

FIG. 3 is a block diagram showing the basic components of an electrographic printer which incorporates the novel cleaning device of the present invention. This electrographic printer is similar in construction to that described in allowed application Ser. No. 700,813, filed Feb. 11, 1985, which employs the vertically mounted disposable cassette described in application Ser. No. 718,947, filed Apr. 2, 1985.

As illustrated, this printer includes photoconductive belt 110 which is rotated clockwise by means of rollers 111 and 112. Located along the right side of the belt, as viewed in FIG. 3, are the cleaning unit 10, erase lamps 114, main charger 113, and an optical print head 115. On the left side of the unit is the developer 116. This unit contains a toner cartridge 118 for convenient handling. Located at the top of the belt path is a transfer unit 119, which unit creates an electric field to attract toner from photoconductive belt 110 onto the underside of sheets of paper passing through the image transfer region 125.

The copy material, e.g., paper, is derived from either of two convenient paper handling cassettes 120 and 121. The paper is directed along either of two paper paths 122-1 or 122-2 to the image transfer region 125 located between the upper roller 111 and the transfer unit 119. From the image transfer region 125, the paper is then transported to a fuser unit 123 by means of a vacuum transport unit 124 and finally deposited in an output tray 125.

The operation of the printer involves a single rotation of the belt per copy produced. During this rotation, the belt is uniformly charged as it passes main charger 113. A latent image is generated by means of the optical print head 115, which can be either a laser o an LED array. The optical print head serves to discharge selected portions of the uniformly charged photoconductive belt as it moves past the optical print head. The latent image thus formed is developed by the deposition of the toner from the developer unit 116. Illustratively, the toner is deposited only on the discharged portions of the photoconductive belt. The belt then enters the transfer region wherein the developed image is transferred to the underside of the paper. In the transfer region 125, the transfer unit 119 serves to form an electric field which attracts toner from the photoconductive belt to the underside of the paper.

As the belt continues to rotate following image transfer, it immediately enters into the region of cleaning device 10. The residual particles are removed from the belt as described hereinabove and the belt is uniformly discharged by erase lamps 114. The belt is thereby readied for the next copy.

The cleaning device of the present invention is successful in removing the residual developer particles from the photoconductive belt without suffering from the problems of prior art cleaning devices.

While the invention has been described by reference to specific embodiments, this was for purposes of illustration only and should not be construed to limit the spirit or the scope of the invention.

What is claimed is:

1. A cleaning device for removing residual developer particles from a photoconductive element in an electrographic printing apparatus, comprising a stationary hollow cleaning sleeve, said cleaning sleeve being maintained at a biasing voltage.

screen mesh means forming a portion of the outer surface of said cleaning sleeve for being held in contact with and for removing residual toner from a photoconductive element, said screen mesh means having an array of apertures therein for passage of developer particles therethrough, and a conveying auger disposed within said cleaning sleeve.

2. The cleaning device of claim 1 wherein said biasing voltage is about +150 V.

3. The cleaning device of claim 1 wherein said cleaning sleeve is made from a metal or a conductive plastic material.

4. The cleaning device of claim 1 wherein said cleaning sleeve is in the form of a hollow cylinder.

5. The cleaning device of claim 4 wherein said screen mesh means subtends about 60° of the surface of said cylinder.

6. The cleaning device of claim 1 wherein said apertures are about 200 microns in diameter.

7. The cleaning device of claim 1 wherein said photoconductive element comprises a photoconductive belt.

8. A method for cleaning residual developer particles from a photoconductive element in an electrographic printing apparatus, comprising rotating a photoconductive element, maintaining a screen in stationary contact with said rotating photoconductive element, said screen having an array of apertures therein, applying a biasing voltage to said screen to attract said developer particles to said screen, passing said residual developer particles through said apertures, and mechanically carrying away said residual developer particles which have passed through said apertures.

9. The method of claim 8 wherein said biasing voltage is about +150 V.

10. The method of claim 8 further comprising recycling said residual developer particles.

* * * * *